United States Patent [19]

Anderson

[11] 4,221,163

[45] Sep. 9, 1980

[54] MAGNETIC HYSTERESIS DRIVEN RECORDING ELEMENT AND METHOD

[75] Inventor: Jeff L. Anderson, Cambridge, Ohio

[73] Assignee: NCR Corporation, Dayton, Ohio

[21] Appl. No.: 939,160

[22] Filed: Sep. 1, 1978

[51] Int. Cl.[3] ..... B41J 9/02

[52] U.S. Cl. ..... 101/93.01; 101/93.29; 101/93.48; 335/153; 335/234

[58] Field of Search ..... 101/93.02, 93.09, 93.14, 101/93.01, 93.29–93.34, 93.48; 335/153, 207, 234.5; 188/164; 346/78; 400/124

[56] References Cited

U.S. PATENT DOCUMENTS

| | | | |
|---|---|---|---|
| 3,449,639 | 6/1969 | Brown et al. | 101/93.48 X |
| 3,711,804 | 1/1973 | Kroft et al. | 101/93.48 X |
| 3,730,317 | 5/1973 | Jaeschke | 188/164 X |
| 3,741,113 | 6/1973 | Mako et al. | 101/93.02 |
| 3,805,378 | 4/1974 | Archer et al. | 335/153 X |
| 3,878,778 | 4/1975 | Gomi | 101/93.29 |
| 3,924,528 | 12/1975 | Ludin | 101/93.29 X |
| 3,949,334 | 4/1976 | Launt | 335/153 |

OTHER PUBLICATIONS

Sakmann, IBM Tech. Discl. Bulletin, vol. 13, No. 8, Jan. 1971, pp. 2130–2131.

*Primary Examiner*—Edward M. Coven
*Attorney, Agent, or Firm*—J. T. Cavender; Wilbert Hawk, Jr.; George J. Muckenthaler

[57] ABSTRACT

A magnetic field is applied to a recording element by energization of an electromagnet or by a permanent magnet to a saturation point of the element material to cause the recording element to move in relation to the electromagnet or to the permanent magnet when the magnetic field is reversed. The polarity opposes or reverses the field to enable a controlled repulsion force and causes the recording element to move in an opposite direction. Magnetic hysteresis is thus utilized in the repulsion and attraction of such an element in both directions of movement.

16 Claims, 9 Drawing Figures

MAGNETIC HYSTERESIS DRIVEN RECORDING ELEMENT AND METHOD

BACKGROUND OF THE INVENTION

In the area of cyclic mechanical motions, there have been various ways and means for driving an element or device for a small distance at extremely fast operation. The element or device may be a specific part of a mechanism which operates in a repeatable and controlled manner in an application utilizing a concept of magnetic repulsion. Examples of such type mechanism may include a striking mechanism for impression of a character or portion of a character onto a record paper, as used in a high-speed electromechanical printer, a pulsed electromagnetic valve or valve-pump combination for metering of a fluid, as used in the fuel injection system of an internal combustion engine, or an electromagnetic hammer for swaging, staking, riveting or stapling parts, as used in various production machines.

The ways and means used in the prior art have included at least two concepts for translating the forces of a magnetic field into a mechanical force or movement for driving an element or device of a mechanism. One concept utilizes a magnetic field which is applied across a magnetic gap or like discontinuity, wherein a magnetically permeable part is placed or positioned near the discontinuity in a manner to cause a portion of the magnetic flux to pass through the permeable part, and the magnetic field then exerts a force on the permeable part which tends to move the part to close the gap or discontinuity. This concept or principle of operation is applied typically to relays and solenoids. As long as the materials of the various parts involved do not become magnetically saturated, the mechanical force will be directly proportional to the magnetic flux that is common to the magnetic field generator and the moving part, and the mechanical force will always be in a direction which tends to minimize the flux path.

The second concept also utilizes a magnetic field which is applied across a magnetic gap or discontinuity, and a magnetically polarized part is placed or positioned in proximity to this gap, so that some of the magnetic flux will pass through the polarized part. The magnetic field exerts a mechanical force on the polarized part in a direction which tends to align the polarization of the part with the field flux. This second concept or principle of operation is applied typically to motors and bi-directional servomechanisms. So long as the materials of the various parts involved do not become mechanically saturated, the mechanical force will be directly proportional to the magnetic flux that is common to the field generator and the polarized part, and the mechanical force will always be in a direction which tends to align the polarization of the moving part with the field flux.

In the concepts or principles of operation of the prior art mentioned above, the operating parameters are chosen so that none of the materials involved in the magnetic path will become saturated during normal operation. In the first mentioned concept, saturation is avoided because any field in excess of saturation will no longer cause a corresponding increase in the mechanical force, which is the desired end result of this concept. As a consequence, saturation is a wasted effort when using the principles of operation of this concept. In the second mentioned concept, saturation is also avoided because of the wasted effort noted above. Saturation is also avoided when using the second concept because this mode of operation frequently makes use of magnetically reluctant materials for the polarized portion of the magnetic circuit. If this type of polarized material is subjected to saturation, then the polarization could be changed or cancelled and the machine operation likewise changed or inhibited. The use of a solenoid or like electromagnetic device has been common to provide the energy and driving force for moving print hammers in printing operations. The use of magnetic and electromagnetic devices has included different concepts for use in operating or driving the various printing elements, for example, in a high speed printer.

Representative prior art relating to the present invention includes U.S. Pat. No. 2,785,390 issued to J. A. Rajchman on Mar. 12, 1957, which discloses devices using hysteretic characteristics of magnetic and ferroelectric materials wherein information may be shifted from a core to a cell by applying shift pulses to change the direction of magnetization of the core, or to change the direction of polarization of the cell.

U.S. Pat. No. 3,264,618 issued to C. L. Wanlass et al. on Aug. 2, 1966, shows a four electrode ferroelectric memory element wherein an electric field can be applied either parallel or orthogonal to the polarization axis, the relation between the applied electric field and the polarization charge of the material being substantially a square hysteresis loop.

U.S. Pat. No. 3,381,611 issued to T. P. Foley on May 7, 1968 discloses an adjustable electromagnetic type slug holder wherein the strength of the magnetic field is adjusted to maintain a predetermined position. The magnetic lines of flux through the printing type provide the attraction force which is directly proportional to the amount of current in the winding.

U.S. Pat. No. 3,730,317 issued to R. L. Jaeschke on May 1, 1973 shows a magnetic coupling wherein energization of the coil to one polarity effects magnetization of the armature to an engaged position and energization of the coil to another polarity effects magnetization of the armature to a disengaged position.

SUMMARY OF THE INVENTION

The present invention relates to magnetic hysteresis effects and more particularly, to induced repulsion due to magnetic hysteresis wherein the magnetic hardness of the material is a measure of the magnetic field intensity required to saturate the material in relation to the field intensity generated within the material. A common property of a magnetically hard material is the hysteresis characteristic wherein an internal field is induced in the material, the material requires a higher intensity field to reverse the internal field than was required to create the original polarization. This polarization is time-dependent such that if an external field is quickly applied with sufficient intensity to change the polarity, there will be a time lag while the internal field changes, this time lag being the time hysteresis effect utilized in the present invention.

A piece of magnetically hard material is placed in the gap of an electromagnet so that the electromagnetic flux will pass through the piece of material, and if the electromagnetic flux or field is increased until the internal field of the magnetic piece is saturated to polarity, and if the field is instantaneously reversed, then the magnetic piece will have a polarity aligned with the magnetic flux or field prior to the reversal of the field and immediately following the reversal of the field, the polarity will oppose the field and soon after the reversal, the polarity will realign with the magnetic field.

In the present invention, a concept or principle of operation is disclosed in which an element of a magnetic circuit will be intentionally driven beyond saturation, whereby the use of this concept results in certain novel properties, and when the circuit design makes use of these properties, considerable improvement in performance can be gained. A generalized design structure making use of the principles of this invention has a magnetic field generator with a discontinuity or gap in the flux path. An element or portion of the design structure will be placed in or near this gap so that the flux from the generated field will pass through the element, such element being so constructed that some of the material subjected to the flux has a magnetic reluctance, and this element is capable of retaining a magnetic polarization. Means is included for control of the intensity of the field so that the field may be increased sufficiently to polarize this element, such control means including provisions for control of the intensity level of the field and for reversal of the field polarity.

Control of the magnetic field is exercised through the means provided so that the field increases sufficiently to polarize the magnetically reluctant part or element, whereupon the field is then decreased to zero, reversed, and increased again to re-polarize the element in the reversed direction. During this activity, the magnetically reluctant element is first attracted to the field gap as the field is increased, and the element remains attracted to the gap as the field induces a polarization within it and also during the time that the field returns to zero. When the field is at zero, the element remains attracted to the gap by virtue of the induced polarization. When the reversed field is applied, the polarization element is repelled from the gap because of the opposing field, and when the field becomes sufficiently intense to re-polarize the element, then the polarization re-aligns with the generated field and the element is again attracted toward the magnetic gap.

The invention exhibits two basic improvements over the prior art, wherein with respect to the first concept mentioned above, one provides for constant forces to act on the moving parts of the machine. Therefore, the moving part always has a directional force applied and no extra force need to be used for the positive return of the part to the start position. Referring to the second concept mentioned above, another improvement is in the operating speed, wherein under periodic cycling of machines which use the second concept from the prior art and the principle of this invention, it should be noted that the machine using this invention will cycle once each time the applied field is reversed in a manner wherein the magnitude of the field is sufficient to saturate the moving part and the reversed field repels the part prior to attraction thereof. A machine using the prior art will require two reversals of the applied field to complete a cycle with one reversal acting to move the part in one direction and the second reversal acting to move the part in the opposite direction.

The novelty of this invention resides in the principle of operation which allows improvement for performance with existing configurations, and allows improvement of the configuration for performance of existing functions, and allows new configurations which perform new functions.

In view of the above discussion, the principal object of the present invention is to provide means utilizing a magnetic hysteresis effect in the cyclic operation of recording elements.

Another object of the present invention is to provide an application for induced repulsion due to magnetic hysteresis effect.

An additional object of the present invention is to provide magnetic hysteresis effect for controlling rebound movement of recording element.

A further object of the present invention is to provide magnetic hysteresis effect in moving printing mechanism in one direction and for utilizing the effect in a return path so as to reduce the cost and improve the reliability of the printing mechanism wherein the return mechanism is eliminated thereby reducing mechanical interference, the mass of the element and the opposing force so as to increase the speed of operation.

Additional advantages and features of the present invention will become apparent and fully understood from a reading of the following description taken together with the annexed drawing.

DESCRIPTION OF THE PREFERRED EMBODIMENT

Figure 1:
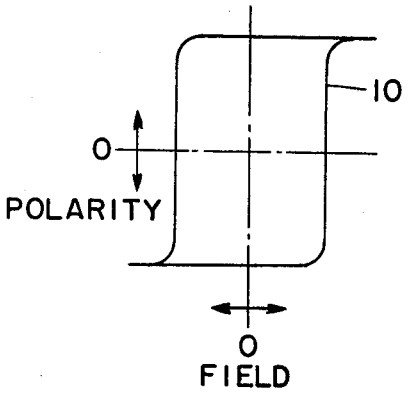
FIG. 1 is a typical hysteresis curve for a magnetically hard material.

Referring to the drawing, FIG. 1 shows a typical hysteresis curve or loop 10 for a "magnetically-hard" material wherein the applied field intensity is illustrated in the X or abscissa direction from a zero (0) plane and the polarity is illustrated in the Y or ordinate direction from a zero (0) plane. The closed curve or loop shows the induction of magnetization in the magnetic material or substance as a function of the magnetization force for a complete cycle thereof and has two values of magnetic flux density, one density occurring when the magnetizing force is increasing and the other value when the magnetizing force is decreasing for each value of the magnetizing forces.

The magnetic hardness of a material is the measurement of the intensity of a field that is required to saturate the material in relation to the intensity of the field generated within the material, the magnetic saturation being the point where application of a further increase in magnetizing force or magnetic field strength produces little or no increase in the magnetic lines of force. Whether or not the hardness of a magnetic material is a desirable feature in the concept utilizing the effects of magnetism depends upon the application of the material. If the application of the material calls for repeated and linear changes in the magnetic field, the so-called hard magnetic materials such as an electromagnet, should not be used. On the other hand, if the application calls for a steady field or a field which is resistant to changes, then the hard materials such as a permanent magnet would be appropriate to use.

Another property or characteristic of a hard magnetic material is the concept of hysteresis or the amount that the magnetization of a ferrous substance lags the magnetizing force because of molecular friction, also namely the property by virtue of which the magnetic induction or magnetic flux density for a given magnetizing force depends upon the previous conditions of magnetization. When an internal field is induced in the material, the material requires a higher intensity field to reverse the internal field than was required to create the original polarization. This effect is shown graphically in an ideal hysteresis loop of FIG. 1. The polarization i.e., the magnetic orientation of molecules in a piece of iron or other magnetizable material placed in a magnetic field whereby the tiny internal magnets tend to align with the magnetic lines of force, is also time-dependent so that if the external field is quickly applied with sufficient intensity to change the polarity, there will be a time lag while the internal field changes in value. The time hysteresis concept is the time lag from the time an external magnetic field is applied with sufficient intensity to change the polarity to the time that the internal magnetic field is changed. The hardness of the material, the strength of the external field and the rate of change of the field are certain variables which determine or depend upon the speed of the application.

Figure 2A:
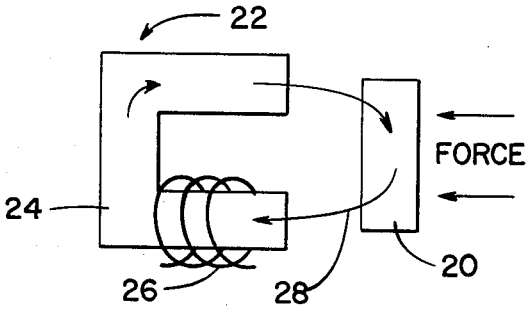
FIGS. 2A, 2B and 2C illustrate diagrammatically the action of the magnetic field and a magnetic element in accordance with the principle of the present invention.
Figure 2B:
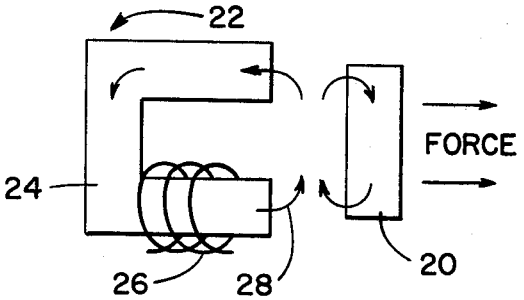
Figure 2C:
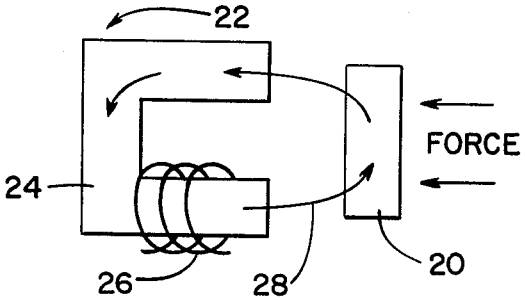

FIGS. 2A, 2B and 2C show the action of the magnetic field and the movement of an associated element as affected by the magnetic field. An element 20 of magnetically-hard material is placed or positioned near or in the gap of an electromagnet 22 which includes a core 24 and a winding or coil 26 with the electromagnetic flux or field 28 passing in a path through the element 20. If the field is increased until the internal flux or polarity of element 20 is saturated and if the field is instantaneously reversed, then the element has a polarity aligned with the field prior to the reversal, as seen in FIG. 2A, wherein the element 20 is polarized by the field 28 of the electromagnet 22 and the element is pulled with a force as shown by the arrows in the direction toward the electromagnet. FIG. 2B shows the activity wherein immediately following the reversal of the field, the polarity of the element 20 opposes the field 28 which is in a manner that the electromagnet 22 has reversed its field but the polarity of the element 20 has not changed and the element is moved away from the electromagnet. Soon after the electromagnet 22 has reversed its field, the polarity of the element 20 is again aligned with the electromagnetic field 28 and the element is pulled toward the electromagnet, as seen in FIG. 2C.

If the element 20 is arranged in relation to the electromagnet 22 so that alignment of the field and polarity causes a magnetic force in a direction in which the element is free to travel, as in the case of a solenoid configuration, when the field is applied, the element will become saturated and move toward the electromagnet to the limit of its travel. When the magnetic field is reversed, the polarity temporarily opposes the field and causes the force to act in the opposite direction and the element 20 momentarily moves away from the electromagnet 22. As soon as the polarity again aligns with the field, the element 20 moves back toward the electromagnet 22 to the limit of its travel.

The impulse movement as just described could be useful in association with various type recording applications as, for example, with the print hammers of drum or band printers, with the wires or dot generators of dot matrix-type printers, with the ink droplet generating impulse valves as employed in ink-jet printers, and with tape or card punch devices or any other record preparing application requiring a fast and small movement of cyclic mechanical motion.

It can be seen that several advantages are inherent in a hysteresis-driven hammer or the like. First, since the hammer is magnetically driven in both directions, a separate return mechanism is not required, which reduces the cost and improves reliability of operation. Additionally, the elimination of the mechanical interference, mass and opposing force of a return mechanism increases the operating speed. And still further, the impulse time and force of the hysteresis- driven hammer are dependent upon inherent properties of the construction materials employed and the electrical control of the magnetic field used therewith.

It is thus seen that the time lag of the changing internal field (the time hysteresis effect) is applied to control the rebound movement of a recording element. The initial energization of the magnetic field generates a flux which flows through the adjacent impact member or hammer in an amount or magnitude to cause magnetic saturation cf the material in the hammer and to tend to draw the hammer toward the flux generating means. When the magnetic field is suddenly reversed, the time hysteresis effect or time lag of the internal field creates a repulsion force to move the hammer from the flux generating means until the polarity in the hammer is realigned with the magnetic flux which again causes the hammer to be moved toward the flux generating means. In this manner the magnetic field is applied according to the design parameters and timed so as to cause movement of the recording element in a first direction under control of the amount and direction of the magnetic field, and to cause movement of the element in a second direction under control of the magnetic field in a rebound movement of the element.

Figure 3:
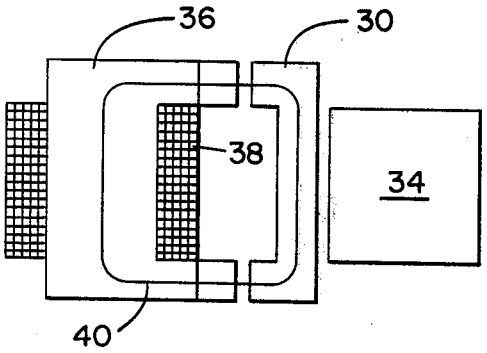
FIG. 3 is a diagrammatic view of the parts in a preferred embodiment of the present invention.
Figure 4:
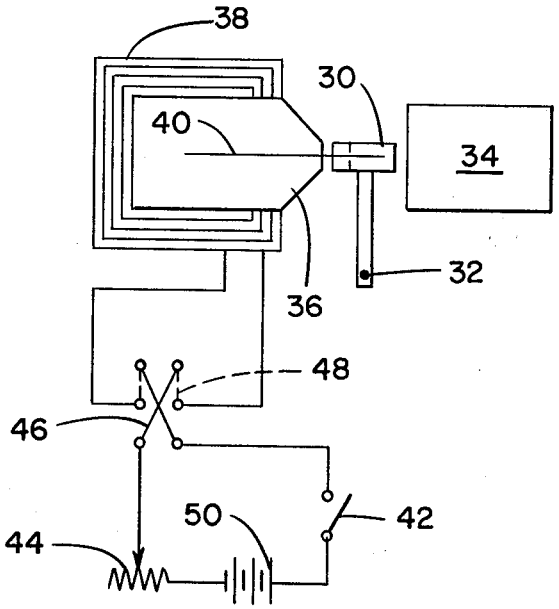
FIG. 4 is a diagrammatic view of the parts of FIG. 3 and showing circuitry therefor.

FIGS. 3 and 4 show in diagrammatic form a preferred embodiment of the invention wherein a hammer 30 of magnetically- reluctant material is supported on a pivot 32 and is positioned so that the hammer is freely swingable between an anvil or platen 34 and an electromagnet 36, but is restrained from moving out of alignment with either of these parts. The electromagnet windings 38 are energized by electrical circuitry which controls the current and the windings develop a magnetic flux path as indicated by 40. The electrical circuitry (FIG. 4) is identified generally by an on/off switch 42, a rheostat 44 and a reversing switch 46 which is shown in the upward position as indicated by the dotted line 48 with the circuitry being supplied by a source of power in the nature of a battery 50.

Figure 5A:
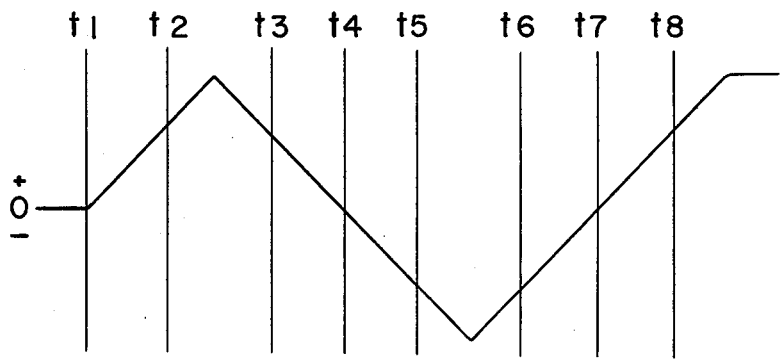
FIGS. 5A, 5B, and 5C illustrate a graphical representation of the action during a typical cycle of operation.
Figure 5B:
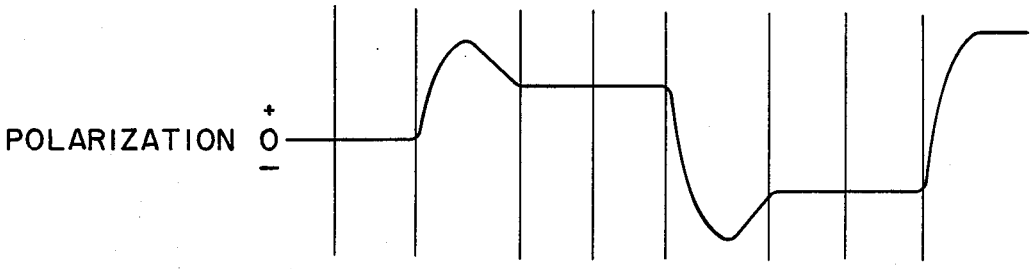
Figure 5C:
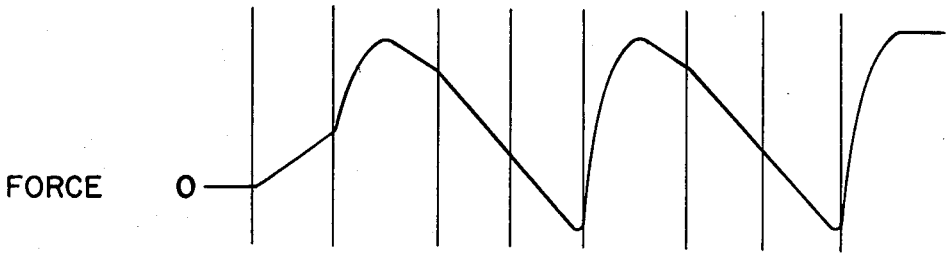

Referring now to FIGS. 5A, 5B and 5C of the drawing, the activity which takes place during an operating cycle of the invention embodiment as illustrated in FIGS. 3 and 4 is represented in graphical form. The line labeled FIELD in FIG. 5A represents the intensity and direction of the field of the electromagnet 36 as the cycle progresses, wherein the magnetic field is roughly proportional to the electric current passing through the windings 38 as controlled by the circuitry provided. The line labeled POLARIZATION in FIG. 5B represents the intensity and direction of the polarization in the hammer 30 during the cycle of operation, with the polarization being a result of the applied field 40 of the electromagnet 36 and the inherent properties of the hammer 30. The line labeled FORCE in FIG. 5C represents the mechanical force exerted on the hammer 30 in a direction either toward or away from the electromagnet 36 with such force being a result of the interaction between the polarization of the hammer and the field of the electromagnet.

The time scale or periods as indicated by the vertical lines in FIGS. 5A, 5B and 5C are the same for the graphs of all three activities and these lines intersect all of the graphs at points which represent simultaneous events in a cycle of operation. Referring to the vertical line indicated by time t1 as the starting point for the description of the operating cycle, the electromagnetic field 40 has not been energized (the field is at 0), the hammer 30 has not been polarized (polarization is at 0) and the hammer is not attracted or repelled by the electromagnet 36 (force is at 0). During the time indicated between time t1 and the time t2, the field 40 of the electromagnet 36 is increased to approach the polarization threshold of the hammer and while the hammer is not yet polarized, the force attracts the hammer to the electromagnet. From time t2 to time t3 the applied field 40 increases to a peak and begins to return to 0 with the field reaching a point during this period where the intensity is sufficient to polarize the hammer 30 and since this polarization is in line with the field, the mechanical force continues to attract the hammer toward the electromagnet 36. From time t3 to time t4 the electromagnetic field 40 returns to 0, the hammer 30 retains its polarization, and the residual magnetism maintains a pull of the hammer toward the electromagnet 36. From time t4 to time t5 the field 40 beings to increase, but in a reversed direction and polarization of the hammer 30 remains unchanged in an action which opposes the reversed field and causes the force on the hammer to change in direction. From time t5 to time t6 the intensity of the electromagnetic field 40 becomes sufficient to repolarize or again polarize the hammer 30 wherein the hammer becomes repolarized in line with the field of the electromagnet 36 and causes the hammer to again be drawn toward the electromagnet. The cycle of operation which occurred between time t2 and time t5 is repeated between time t5 and time t8 with the field and polarization directions being reversed, but with the same resulting forces on the hammer 30. The cycle of changing forces continues in repetitive manner with each reversal of polarity of the electromagnet 36.

Referring to the force graph of FIG. 5C, the available work from the mechanism is a function of the alternate attraction and repulsion between the electromagnet 36 and the hammer 30. This alternate action occurs once for each reversal of the electromagnet field and the time force and direction characteristics of this force are related in a non-linear manner to the field. By reason of the repetitive cycling of the force for each reversal of the field, this method of operation can be used to improve the speed in recording mechanisms such as printers and the like. By reason of the non-linear relationship between the field and the resulting force, and because the nature of the non-linear relationship depends on the materials, the configuration, the respective time periods and the electromagnetic field arrangements, this method of operation can be used as a means of enhancing specific portions of the force cycle.

It is thus seen that herein shown and described is a concept of utilizing magnetic action in a hysteresis-driven element for moving such element in back-and-forth direction. The structure controlled by the magnetic action of the present invention enables the accomplishment of the objects and advantages mentioned above, and while a preferred embodiment has been disclosed herein, variations thereof may occur to those skilled in the art. It is contemplated that all such variations and modifications not departing from the spirit and scope of the invention hereof are to be construed in accordance with the following claims.

What is claimed is:

1. A system for cyclic operation of a recording member comprising:

means for generating a magnetic flux in a predetermined direction, said recording member being adjacent said generating means for receiving the effect of said magnetic flux in a magnitude to saturate the material in said recording member and retain a magnetic polarity therein in said direction and to cause said recording member to be moved toward said generating means, and switching means for reversing the magnetic flux in the opposite direction and in a magnitude causing a time-delayed change in polarity of said recording member and causing said recording member to move away from said generating means, the magnitude of said reversed flux then causing said polarity to be realigned with said magnetic flux to cause said recording member to be moved again toward said generating means.

2. The system of claim 1 wherein said recording member is of magnetically permeable material and said generating means is an electromagnet.

3. The system of claim 1 wherein said recording member is of magnetically reluctant material and said generating means is an electromagnet.

4. The system of claim 1 wherein said recording member is a striking element movable from one to another position.

5. The system of claim 1 wherein said recording member is an electromagnetic driven hammer.

6. In apparatus for producing cyclic motion of a recording element by magnetic action;

means for generating a magnetic field in one direction in a path through said element and in a manner to effect saturation of said element, and to move said element toward said generating means and to polarize said element in said one direction, and means for reversing said magnetic field in the other direction in said path wherein the polarity in said element is time-delayed and initially opposes the magnetic field and causes said element to be moved away from said generating means, the magnitude of such reversed field then causing said element to be polarized in said other direction and to be aligned with the magnetic field to cause said element to be moved again toward said generating means.

7. In the apparatus of claim 6 wherein said recording element is of magnetically permeable material and said generating means is an electromagnet.

8. In the apparatus of claim 6 wherein said recording element is of magnetically reluctant material and said generating means is an electromagnet.

9. In the apparatus of claim 6 wherein said recording element is a striking member movable from one to another position.

10. A method of moving a recording element in cyclic motion comprising the steps of:

placing said element in the gap of an electromagnet, generating a magnetic field in a path through the element of a magnitude to effect saturation thereof and to polarize said element in a first direction of the path of the magnetic field and to cause said element to move in one direction, and reversing the magnetic field in said path in a second direction to initially oppose the polarity in said element and cause said element to move in the opposite direction, the magnitude of the reversed magnetic field being sufficient to cause the polarity to be aligned with the magnetic field in the second direction and again move said element in said one direction.

11. The method of claim 10 wherein said recording element is of magnetically permeable material and the step of generating said magnetic field provides for the use of an electromagnet.

12. The method of claim 10 wherein said recording element is of magnetically reluctant material and said reversed magnetic field is of an intensity to change the polarity of said element in time-delayed manner.

13. The method of claim 10 including the additional step of controlling the reversing of the magnetic field in a manner causing a delay in the change of polarity for moving said element in the opposite direction.

14. In a printer having a platen, a hammer for impacting against said platen, and means for moving said hammer toward and away from said platen, comprising:

magnetic means adjacent said hammer for generating a magnetic flux in a path in a first direction through said hammer in an amount to saturate said hammer and to polarize said hammer in said first direction and to cause said hammer to move in a direction toward said magnetic means, and means for reversing the magnetic flux in an amount in a second direction to initially oppose the polarity in said hammer in said first direction and delaying the change in polarity to the second direction and cause said hammer to be moved in a direction away from said magnetic means, the amount of such reversed magnetic flux then causing said hammer to be polarized in said second direction and to be aligned with the magnetic flux to cause said hammer to be moved again toward said magnetic means.

15. In the printer of claim 14 wherein said hammer is of magnetically permeable material and said magnetic means is an electromagnet.

16. In the printer of claim 14 wherein said hammer is of magnetically reluctant material and said magnetic means is an electromagnet.

* * * * *